US006287135B1

(12) United States Patent
Hashiguchi et al.

(10) Patent No.: US 6,287,135 B1
(45) Date of Patent: Sep. 11, 2001

(54) CONNECTOR ENGAGING/DISENGAGING DEVICE ACCOMMODATING A PLURALITY OF CONNECTOR PAIRS TO MATE WITH EACH OTHER

(75) Inventors: Osamu Hashiguchi, Akishima; Yoshinori Mizusawa, Tokyo; Toshihiko Maeda, Tachikawa; Masahiro Yamada, Tokyo; Shin Kamiyamane, Tokyo; Satoru Nagase, Tokyo, all of (JP)

(73) Assignee: Japan Aviation Electronics Industries, Ltd., Tokyo (JP)

( * ) Notice: Subject to any disclaimer, the term of this patent is extended or adjusted under 35 U.S.C. 154(b) by 0 days.

(21) Appl. No.: 09/537,980

(22) Filed: Mar. 29, 2000

(30) Foreign Application Priority Data

Mar. 30, 1999 (JP) ..... 11-088483

(51) Int. Cl.[7] ..... H01R 13/62
(52) U.S. Cl. ..... 439/310; 439/928.1
(58) Field of Search ..... 439/310, 61, 355, 439/374, 541.5, 928.1, 157

(56) References Cited

U.S. PATENT DOCUMENTS 5,388,995 * 2/1995 Rudy, Jr. et al. ..... 439/61
5,402,310 * 3/1995 Penniman ..... 361/686
5,823,815 * 10/1998 Takata ..... 439/374

OTHER PUBLICATIONS

European Search Report (The Hague) completed May 19, 2000 (Examiner D. Corrales); application No. EP 00 10 6873.
European Patent Office Communication dated May 26, 2000; Reference No. AG 439–14292.7 re application No. 00106873.3–2308.
German Patent No. DE 298 22 734 U 1 dated Feb. 25, 1999.

* cited by examiner

*Primary Examiner*—Brian Sircus
*Assistant Examiner*—Javaid Nasri
(74) *Attorney, Agent, or Firm*—Laff, Whitesel & Saret, Ltd.; J. Warren Whitesel

(57) ABSTRACT

A connector engaging/disengaging mechanism comprises a frame member (3) and connector carriers (7) for engaging and disengaging first connector (40) mounted on a printed circuit board (5) fixed onto the frame (3) and second connectors (30) held on said connector carriers (7). The frame member is provided with guide grooves (11) in which the connector carriers (7) are received to be slidable in an engaging direction (A) and a disengaging direction (B). Each of the connector carriers (7) has connector holding portions for holding the second connectors and an operating portion (15) for moving the connector carrier to engage and disengage the second connectors (30) to and from the first connector (40). When the operating portion (15) is manually operated to move the connector carrier in the engaging direction, the second connectors (30) are connected with the first connectors (40). When the connector carrier is moved in the disengaging direction, the second connectors (30) are disconnected from the first connectors (40).

13 Claims, 6 Drawing Sheets

CONNECTOR ENGAGING/DISENGAGING DEVICE ACCOMMODATING A PLURALITY OF CONNECTOR PAIRS TO MATE WITH EACH OTHER

BACKGROUND OF THE INVENTION

This invention relates to a connector engaging/disengaging device for engaging and disengaging a plurality of electrical connectors (which will simply be referred to as "connectors") to and from a plurality of mating connectors and, in particular, to a connector engaging/disengaging device for engaging and disengaging a plurality of connectors connected to a plurality of cables to and from a plurality of mating connectors mounted on a printed circuit board for the purpose of data transmission between electronic components.

In existing electronic apparatus, electrical cables (which will simply be referred to as "cables") are used for transmitting signals between electronic parts and connectors are used for making electronic connection between the cables and the parts. For example, in order to electrically connect a particular one of many printed circuit boards with other ones of the printed circuit boards and/or electrical elements through cables, connectors are mounted on the particular circuit board, while the cables are led out from the other printed circuit boards and the electrical elements and mounted with cable connectors at their ends. The cable connectors are engaged with corresponding ones of the connectors mounted on the particular printed circuit board. Each of the cables often has a plurality of conductor lines, although it might have a single conductor line. Accordingly, each of cable connectors has a plurality of contacts or a single contact. In a case, a plurality of cables are accommodated in a single cable connector having a plurality of contacts. Each of the connectors mounted on the particular printed circuit board has a number of contacts equal to the number of contacts in the corresponding one of the cable connectors.

When carrying out wiring operation in a housing of an electronic apparatus, it is necessary to engage and connect connectors to each other. Since the engaging operation is usually performed by a use of hands, the housing is required to have a relatively large space sufficient to enable the manual operation in the housing. This results in a demand for a relatively large-size housing to be used.

In recent electronic apparatus., especially, computers, electronic parts used have been increased in number, and therefore, cables and connectors have also been increased in number. Further, for the demand of small-size of the apparatus itself and of reduction of signal transmission time, it is required that the housing is small-sized, parts being mounted in small mounting density, and cables being reduced in length. Therefore, on one hand, the wiring operation becomes more difficult because manual operation for engaging connectors to each other must be an reduced space in the housing, and, on the other hand, insurance of the manual operation of the wiring make it difficult to small size the apparatus.

SUMMARY OF THE INVENTION

It is an object of this invention to provide a connector engaging/disengaging device which is capable of carrying out an engaging/disengaging operation for a number of connectors and a number of mating connectors accommodated in a small frame.

It is another object of this invention to provide a connector engaging/disengaging device which is capable of easily carrying out an engaging operation for connecting a connector or connectors and a mating connector or connectors after provisional completion of a wiring operation of a cable.

It is yet another object of this invention to provide a connector engaging/disengaging device which enables a reduction in the length of a cable for connecting between electronic parts and/or elements.

This invention provides a connector engaging and disengaging device for electrically connecting a plurality of first connectors having first engaging sides with a plurality of second connectors having second engaging sides by mating the first engaging sides with the second mating sides, respectively, and for disconnecting the first connectors from the second connectors by separating the first engaging sides from the second engaging sides. The device comprises: a hollow frame open at front and rear ends; a supporter fixed to the frame for fixedly supporting the first connectors in a condition where the first connectors are disposed in the rear open end with the first engaging sides being directed to the front open end. A connector carrier is mounted slidable in frontward and rearward in the frame. The connector carrier comprises a connector holding portion disposed in front of the first connectors disposed in the rear open end of the frame for holding the second connectors with the second engaging sides directed to the rear open end, and an operating portion projecting out of the frame for moving the connector carrier in frontward and rearward directions. The second connectors are held on the connector holding portions when the connector carrier is positioned at a first position at the front open end. The second connectors are brought into electrical connection with the first connectors when the connector carrier having the second connectors thereon is pulled to a second position at the rear open end to engage the first engaging sides with the second engaging sides, respectively. The second connectors are electrically disconnected from the first connector when the connector carrier is pulled from the second position to the first position.

Further, this invention provides a connector assembly having a connector engaging/disengaging mechanism for engaging and disengaging a plurality of first connectors to and from a plurality of second connectors in one-to-one correspondence, the first connectors being mounted on a printed circuit board, the second connectors being connected to a plurality of cables, respectively. The assembly comprises: a panel having an opening; a frame member fixedly mounted on the a panel along a periphery of the opening; the printed circuit board fixed onto the frame member inside the opening; the first connectors mounted on the printed circuit board; the second connectors; and the connector engaging/disengaging mechanism. The mechanism comprises a plurality of plate-like connector carriers mounted on the frame member and being slidable in a connector engaging disengaging direction perpendicular to the panel. Each of the connector carriers comprises a plurality of seating plate portions for seating plural ones of the second connectors, a plurality of connector holding portions formed on the seating plate portions to hold the second connectors seated thereon, and a pair of operating portions for moving the connector carrier the connector engaging and disengaging direction to engage and disengage the first connectors to and from the second connectors. The mechanism further comprises a plurality of guide portions for guiding of the connector carrier moving in the engaging and disengaging direction.

DESCRIPTION OF THE PREFERRED EMBODIMENT

Figure 1:
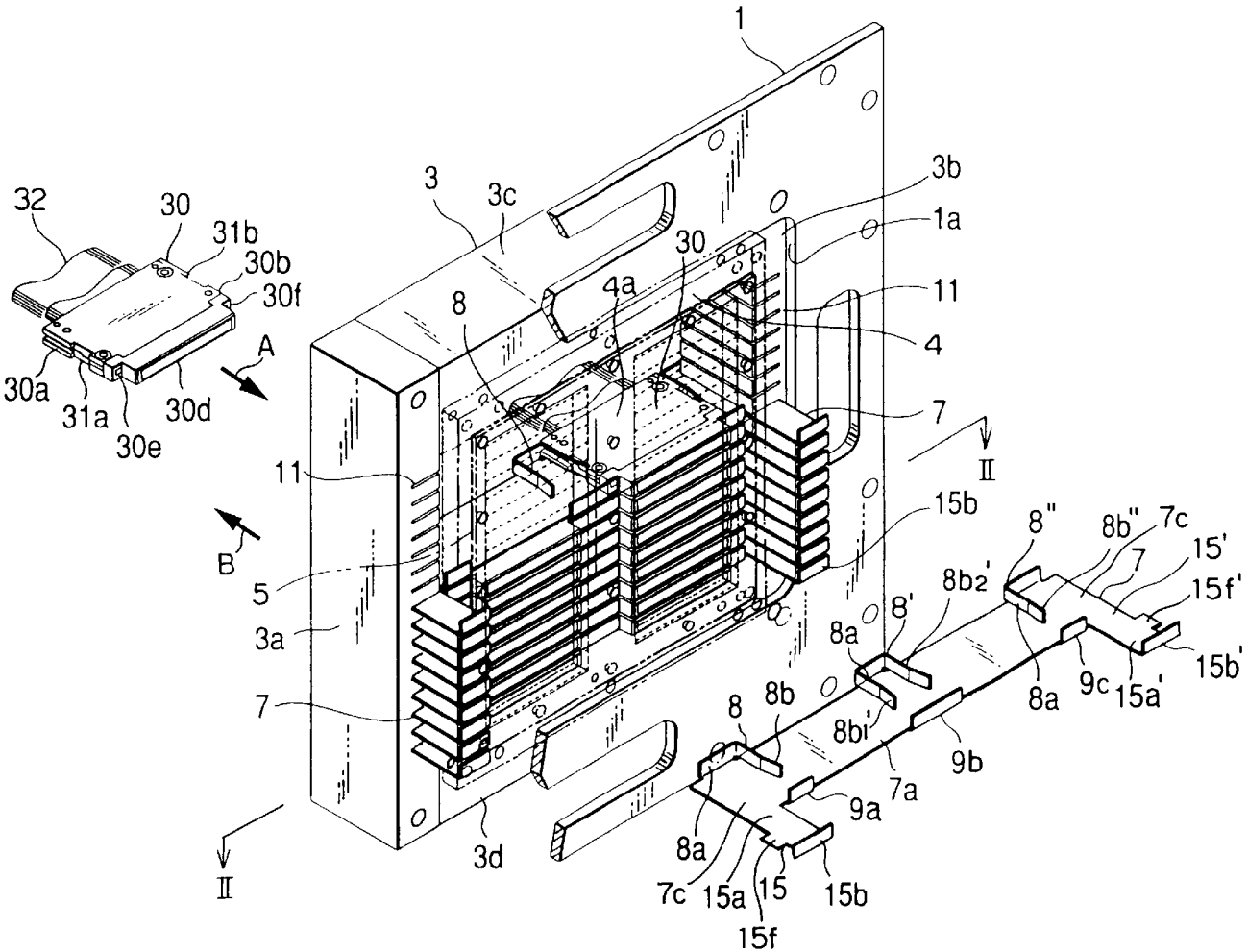
FIG. 1 is an exploded perspective view of a connector assembly with a connector engaging/disengaging mechanism according to one embodiment of this invention.
Figure 2:
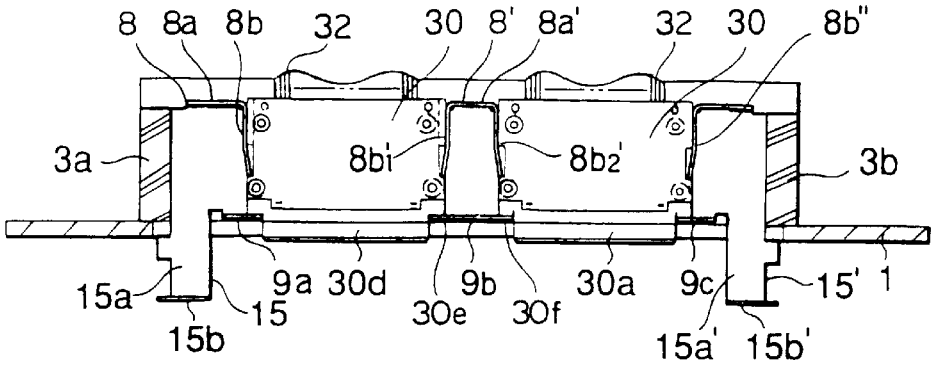
FIG. 2 is a sectional view taken along a line II—II in FIG. 1.
Figure 3:
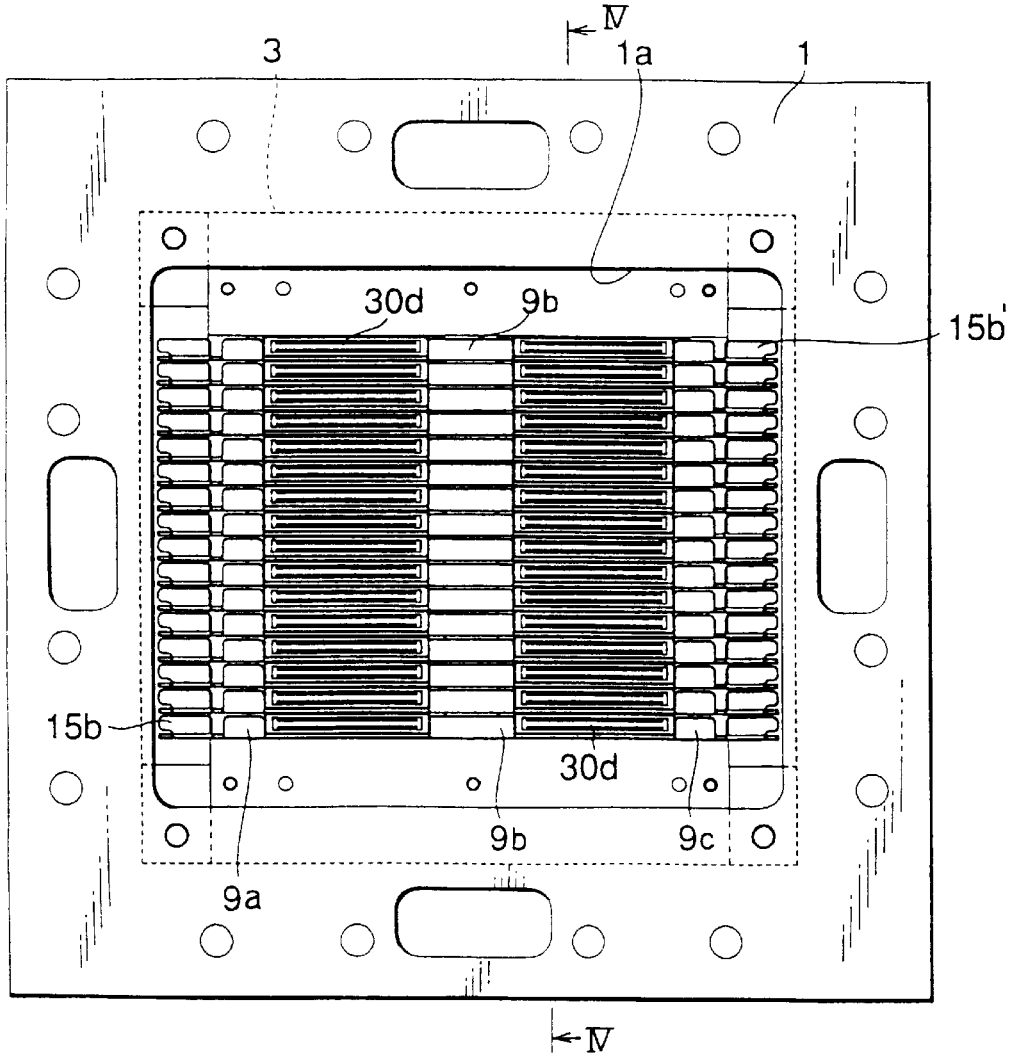
FIG. 3 is a front view of the connector assembly in FIG. 1 with cable connectors assembled therein.
Figure 4:
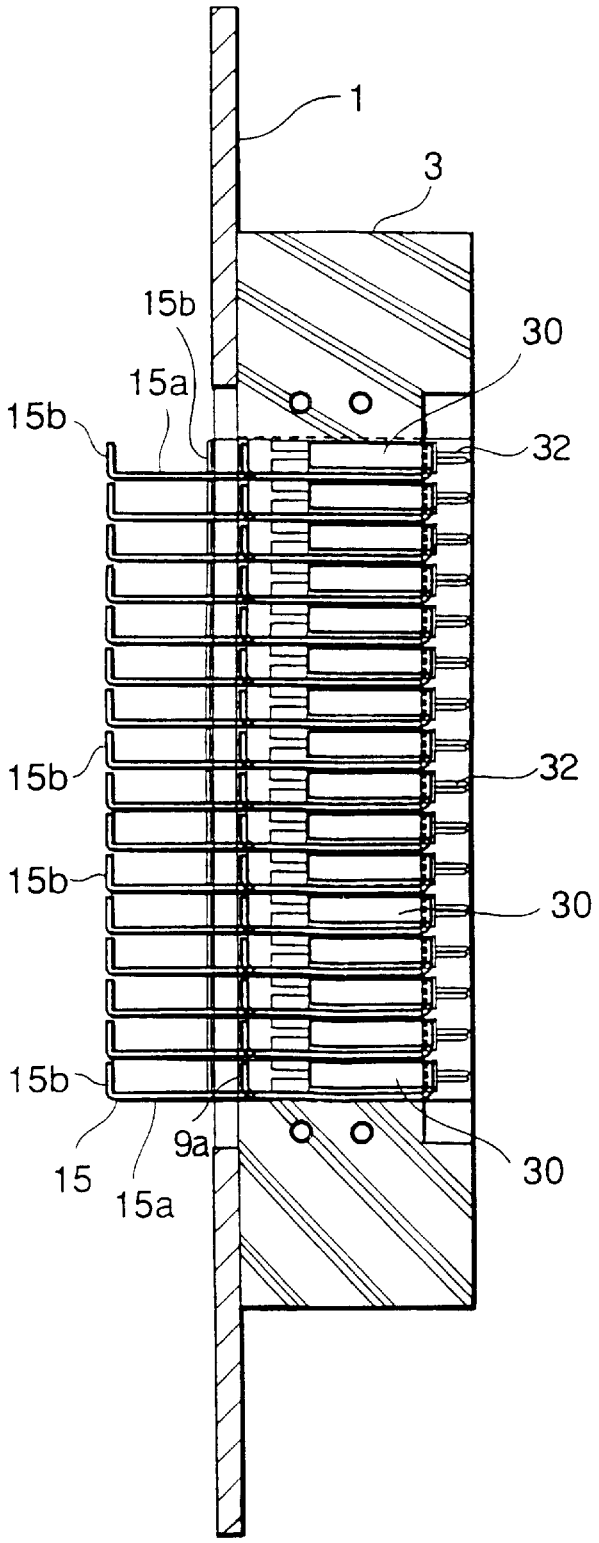
FIG. 4 is a sectional view taken along a line IV—IV in FIG. 3.

Now, description will be made of a connector assembly having a connector engaging/disengaging mechanism according to one embodiment of this invention with reference to the drawing.

Referring to FIGS. 1 through 4, the connector assembly with a engaging/disengaging mechanism comprises a panel 1 with an opening 1*a*, a frame member 3 mounted on a front surface of the panel 1, a metal stiffener 4 attached to a rear surface of the frame member 3, a printed circuit board 5 attached to a rear surface of the stiffener 4, and a plurality of connector carriers 7 held by the frame member 3.

The frame member 3 has a substantially rectangular shape and comprises four side wall portions 3*a* through 3*d*. The panel 1 supports the side wall portions 3*a* through 3*d* along a periphery of the opening 1*a*. The side wall portions 3*a* through 3*d* are fixed to the panel 1 by the use of screws.

Among the side wall portions 3*a* through 3*d*, the left and the right side wall portions 3*a* and 3*b* extend in parallel to each other and in the vertical direction in the figure and are provided with a plurality of guide portions 11. The guide portions 11 are formed at a predetermined interval in the vertical direction of the left and the right side wall portions 3*a* and 3*b*. Each of the guide portions 11 is formed with a pair of guide grooves formed in confronting surfaces of the left and the right side wall portions 3*a* and 3*b* to horizontally extending, each of the guide grooves is a deep groove which is deeply cut towards each of outer surfaces opposite to the confronting surfaces.

The connector carriers 7 are held by the guide portions 11, respectively, to be arranged in parallel to one another in a multi-stage fashion in the vertical direction in the figure. Each of the connector carriers 7 is held by a pair of left and right guide grooves 11 formed in the left and the right side wall portions 3*a* and d3*b* at a same level. More in detail, a pair of flat-plate portions 7*c* at both longitudinal ends of the connector carrier 7 are slidably fit into the left and the right guide grooves 11, respectively. Thus, between the left and the right side wall portions 3*a* and 3*b*, the connector carrier 7 is guided by the left and the right guide grooves 11 to slide in an engaging direction A and a disengaging direction B perpendicular to the panel 1, as depicted by arrows in FIG. 1.

The stiffener 4 of a plate-like shape has a column portion 4*a* vertically extending at the center thereof, and a pair of opening portions symmetrically formed at both sides of the column portion 4*a*. The stiffener 4 serves to prevent the printed circuit board 5 from warping. Furthermore, the stiffener 4 serves to cover a plurality of board connectors 40 (FIG. 5) mounted on the printed circuit board 5 and to prevent the boad connectors 40 from being damaged.

The printed circuit board 5 is attached to the stiffener 4 to close the opening portions of the stiffener 4 and fixed to the rear side edges of the side wall portions 3*a* through 3D. In each of the connector carriers 7, an area between the flat plate portions 7*c* is located in front of the stiffener 4.

The connector carriers 7 serve to engage and disengage a plurality of cable connectors 30 to and from the board connectors 40 mounted on the printed circuit board 5 in one-to-one correspondence in the engaging direction A and the disengaging direction B.

Each of the connector carriers 7 has a seating plate portion 7*a* of a flat-plate shape including the flat plate portions 7*c*, a plurality of connector holding portions 8, 8', and 8" formed on the seating plate portion 7*a*, a pair of operating portions 15 and 15' for moving the connector carrier 7 in the engaging and disengaging directions to connect and disconnect the cable connectors to and from the board connectors, and a plurality of connector stopper portions 9*a*, 9*b*, and 9*c* for restricting the movement of the cable connectors 30 in the engaging direction A on the connector carrier.

The seating plate portion 7*a* has a flat shape to receive a lower surface of each of the cable connectors 30. In the illustrated example, the seating plate portion 7*a* and the flat plate portions 7*c* are coplanar. The connector holding portions 8, 8', and 8" are formed on the seating plate portion 7*a* including the flat plate portions 7*c* at three positions spaced in a longitudinal direction.

Figure 5:
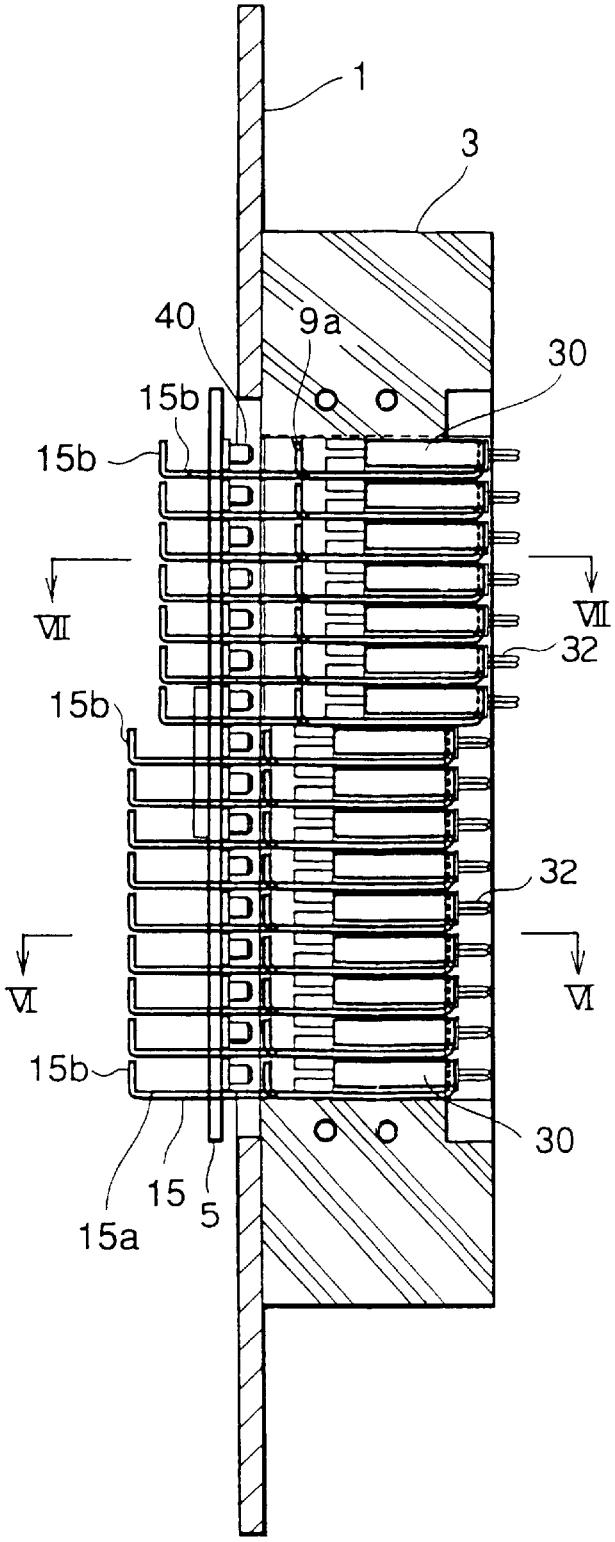
FIG. 5 is a sectional view similar to FIG. 4 together with board connectors mounted on a printed circuit board, showing the states before and after connecting of the cable connectors and the board connectors.

In FIG. 5, the connector carriers 7, sixteen in number, are illustrated. Among those, the seven connector carriers 7 illustrated on an upper side are in the state before connecting of the cable connectors 30 thereon and the corresponding board connectors 40. On the other hand, the nine connector carriers 7 illustrated on a lower side are in the state after connecting of the cable connectors 30 thereon and the corresponding board connectors 40.

Each of the cable connectors 30 has a pair of connector side surfaces 30*a* and 30*b*, a pair of connector locking portions 31*a* and 31*b* formed at intermediate portions of the connector side surfaces 30*a* and 30*b*, and an engaging portion 30*d* to be fit with a mating portion 40*a* of each of the board connectors 40 in the engaging direction A. The engaging portion 30*d* is provided with a pair of shoulder portions 30*e* and 30*f* formed at both sides thereof as stepped portions towards the connector side surfaces 30*a* and 30*b*.

Next, a description will be made in detail about the structure of the connector carrier 7 for moving the cable connectors 30 in the engaging and the disengaging directions A and B. In the illustrated example, two cable connectors 30 are mounted on the seating plate portion 7*a* of each connector carrier 7.

The connector holding portions 8, 8', and 8" are engaged with the connector locking portions 31*a* and 31*b* of the cable connectors 30 in disengaging direction B when the cable connectors 30 are placed at predetermined positions on the seating plate portion 7*a*. The connector stopper portions 9*a*, 9*b*, and 9*c* are abutted to the shoulder portions 30*e* and 30*f* of the connectors 30 in the insert direction A to locate the cable connectors 30 at the predetermined positions.

The connector holding portions 8, 8', and 8" and the connector stopper portions 9*a*, 9*b*, and 9*c* are formed on the seating plate portion 7*a* so as to hold the two connectors 30 in parallel at a predetermined space. The operating portions 15 and 15' extend from the seating plate portion 7*a* in the engaging direction A. The operating portions 15 and 15' are held by the guide portions 11 to protrude to a rear side of the panel 1.

The connector holding portions 8, 8', and 8" are formed in the vicinity of one longitudinal end, at the center, and in the vicinity of the other longitudinal end of the connector carrier 7, respectively. The connector holding portions 8, 8' and 8" have upstanding holding parts 8*a*, 8*a*', and 8*a*" extending from the seating plate portion 7*a* at its rear edge in the engaging direction A, that is, at its front edge in the disconnecting direction B, and spring parts 8*b*, 8*b*'$_1$ and 8*b*'$_2$, and 8*b*" having elasticity and extending from the holding parts 8*a*, 8*a*', and 8*a*" in the insert direction A, respectively.

Thus, the connector holding portions 8, 8', and 8" are formed on the seating plate portion 7*a* so as to hold the cable connectors 30 placed on the seating plate portion 7*a*. The connector holding portion 8' formed at the center of the connector carrier 7 in the longitudinal direction has the holding part 8*a*' at the center and the spring parts 8*b*'$_1$ and 8*b*'$_2$ connected to the both sides of the holding part 8*a*'. The spring parts 8*b*'$_1$ and 8*b*'$_2$ are faced to each other.

The connector holding portions 8 and 8" in the vicinity of the flat plate portions 7*c* at both sides have the holding parts 8*a* and 8*a*" connected to the spring parts 8*b* and 8*b*", respectively. The spring parts 8*b* and 8*b*" are faced to the spring parts 8*b*'$_1$ and 8*b*'$_2$, respectively, with wide spaces kept therebetween. Each of the wide spaces is greater than a space between the spring parts 8*b*'$_1$ and 8*b*'$_2$. Specifically, each of the wide spaces is substantially equal to the width of each the cable connectors 30. It is noted here that the distances from free ends of the spring parts 8*b*'$_1$ and 8*b*'$_2$ to free ends of the spring parts 8*b* and 8*b*", respectively, are smaller than the width of each of the cable connectors 30.

The connector locking portions 31*a* and 31*b* are formed as recesses to receive the free ends of the spring parts 8*b*, 8*b*'$_1$, 8*b*'$_2$, and 8*b*" elastically inserted therein and engaged therewith. In the vicinity of the both longitudinal ends of the connector carrier 7, the connector stopper portions 9*a* and 9*c* are formed to face the forward ends of the spring parts 8*b* and 8*b*", respectively. The connector stopper portion 9*b* formed at the center of the connector carrier 7 is faced to the forward ends of the spring parts 8*b*'$_1$ and 8*b*'$_2$ at the center.

When the operating portions 15 and 15' of the connector carrier 7 are inserted into the guide grooves 11, the connector stopper portions 9*a*, 9*b*, and 9*c* are inhibited by the stiffener 4 from being released.

The connector holding portions 8, 8', and 8" and the connector stopper portions 9*a*, 9*b*, and 9*c* are formed by punching and bending a plate material common to the seating plate portion 7*a*. Specifically, the connector holding portions 8, 8', and 8" and the connector stopper portions 9*a*, 9*b*, and 9*c* are formed by bending the plate material upward from the seating plate portion 7*a*.

The operating portions 15 and 15' are formed from the plate material common to the seating plate portion 7*a*, Each of the operating portions 15 and 15' has an extending part 15*a*, 15'*a* extending on a plane common to the seating plate portion 7*a* towards the rear side of the panel 1, and an operating part 15*b*, 15'*b* bent from an extended end of the extending part 15*a*, 15'*a* to stand up from the extending part 15*a*, 15'*a*. The extending part 15*a*, 15'*a* has a width substantially equal to the depth of the guide groove 11.

Furthermore, the operating portions 15 and 15' have stopper parts 15*f* and 15*f*' protruding outward in the longitudinal direction, respectively. When the connector carrier 7 is moved in the disengaging direction B, the stopper parts 15*f* and 15*f*' are abutted to the front surfaces of the side wall portions 3*a* and 3*b* to inhibit further movement of the connector carrier 7.

Figure 6:
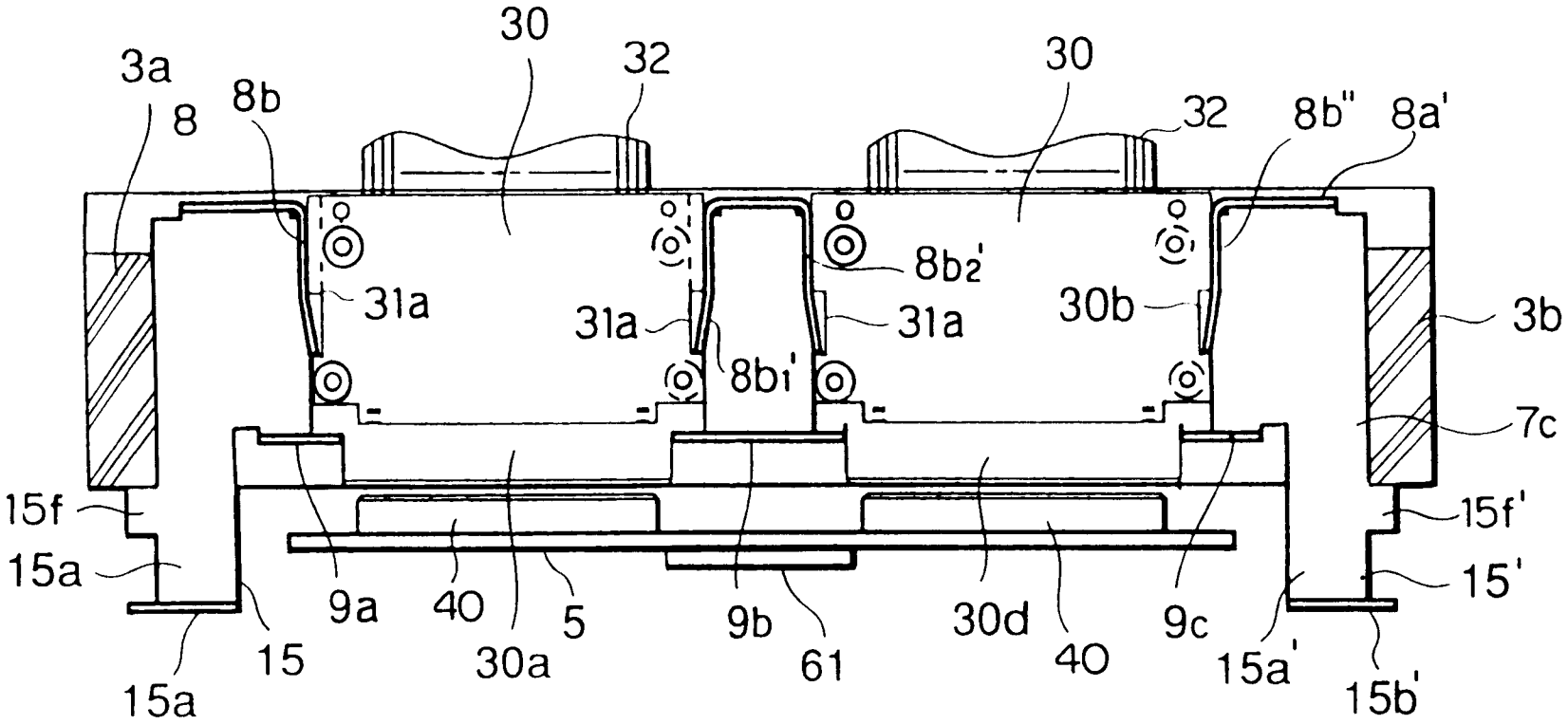
FIG. 6 is a sectional view taken along a line VI—VI in FIG. 5.

As illustrated in FIG. 6, an electronic component 61 such as an LSI package is mounted on the rear surface of the printed circuit board 5. On the front surface of the printed circuit board 5 faced to the engaging portions 30*d* of the cable connectors 30, the coupling portions 40*a* of the board connectors 40 are mounted to mate with the engaging portions 30*d* of the cable connectors 30. In FIG. 6, the stiffener 4 is not illustrated.

Next referring to FIGS. 6 and 7 in addition, assembling and operation of the connector assembly with the engaging/disengaging mechanism will be described.

At first, the flat-plate portions 7*c* of the connector carriers 7 are inserted into the guide portions 11 of the side wall portions 3*a* and 3*b* so that the seating plate portions 7*a* of the connector carriers 7 are slidably supported between the side wall portions 3*a* and 3*b*.

Thereafter, the stiffener 4 attached with the printed circuit board 5 having board connectors mounted thereon is fixed to the frame member 3 by the screws. On the front side of the panel 1, the cable connectors 30 connected to cables 32 are inserted into the connector carrier 7 in the engaging direction A depicted by the arrow A in FIG. 1. Then, the two cable connectors 30 are held by the connector carrier 7, as illustrated in FIG. 6. At this time, the connector locking portions 31*a* and 31*b* of one of the two cable connectors 30 are engaged with the free ends of the spring parts 8*b* and 8*b*'$_1$ of the connector holding portions 8 and 8'. The connector locking portions 31*a* and 31*b* of the other connector 30 are engaged with the free ends of the spring parts 8*b*'$_2$ and 8*b*" of the connector holding portions 8' and 8". In this event, the shoulder portions 30*e* and 30*f* of the connectors 30 are abutted to the connector stopper portions 9*a*, 9*b*, and 9*c* in the insert direction A. Thus, the cable connectors 30 are stationarily held on the connector carrier 7 by the connector holding portions 8, 8', and 8" and the connector stopper portions 9*a*, 9*b*, and 9*c*.

The stopper parts 15*f* and 15*f*' are abutted to the rear surfaces of the side wall portions 3*a* and 3*b* to inhibit further movement of the connector carrier 7 in the disengaging direction B.

Figure 7:
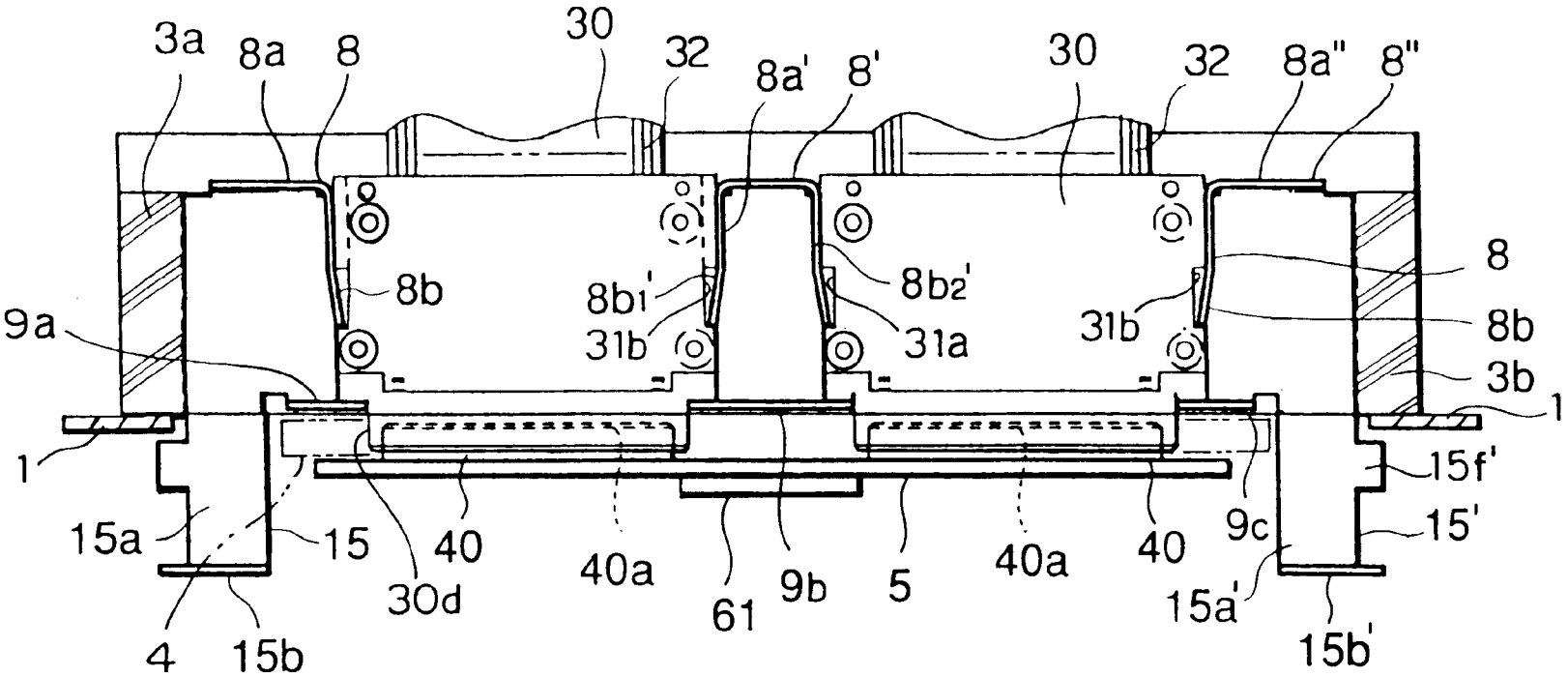
FIG. 7 is a sectional view taken along a line VII—VII in FIG. 5.

When the operating portion 15 is manually operated to slightly pull the connector carrier 7 in the engaging direction A as illustrated in FIG. 7, the cable connectors 30 are pushed by the free ends of the spring parts 8*b*, 8*b*', and 8*b*" to be moved in the engaging direction A. Then, the engaging portions 30*d* of the cable connectors 30 mate with the coupling portions 40*a* of the board connectors 40 mounted on the printed circuit board 5.

At a result, contacts (not shown) of the cable connectors 30 connected to the cable 32 are connected to mating contacts (not shown) of the board connectors 40.

In order to disconnect the cable connectors 30 from the board connectors 40, the operating portions 15 and 15' are pushed in the disengaging direction B. Specifically, when the operating portions 15 and 15' are pushed in the disengaging direction B, the engaging portions 30*d* of the cable connectors 30 are disengaged from the coupling portions 40*a* of the board connectors 40. Thus, by pulling or pushing the connector carrier 7, the cable connectors 30 can be connected or disconnected to or from the board connectors.

In the embodiment described above, description has been made as to the connector assembly having a mechanism for engaging and disengaging cable connectors with board connectors. However, it will be easily noted from the description that the assembly can be used to different types of connectors to be engaged and disengaged each other without being restricted to those cable type and board type connectors. Further, the structure with the cable connectors and the printed circuit board being omitted can be provided as a connector engaging and disengaging device for connecting and disconnecting a plurality of paired connectors to be connected each other.

As described above, with the connector assembly according to this invention, the engaging portions 30*d* of the connectors 30 held on the connector carrier 7 can be engaged or disengaged to and from the coupling portions of the mating connectors 40 by the movement of the connector carrier 7 slidably attached to the frame member 3. Therefore, it is possible to realize a connector assembly having a small-sized connector engaging/disengaging mechanism and therefore, it is also possible to reduce a space for carrying out the connector engaging/disengaging operation in wiring operation. As a result, it is possible to reduce a size of a housing of an electronic apparatus using a lot of connectors therein.

Since the connector carrier 7 has the connector holding portions 8, 8', and 8", the connectors 30 can be easily held. Therefore, connectors 30 can easily be engaged or disengaged to or from the mating connectors 40 by the movement of the connector carrier 7.

Since the connecting operation of the cable connectors 30 and the mating connectors 40 can be carried out within a small space, the cable 32 can be shortened so that the transmission time can be reduced.

What is claimed is:

1. A connector engaging and disengaging device for electrically connecting a plurality of first connectors having first engaging sides with a plurality of second connectors having second engaging sides by mating said first engaging sides with said second mating sides, respectively, and for disconnecting the first connectors from the second connectors by separating said first engaging sides from said second engaging sides, which comprises:

a hollow frame (1, 3) open at front and rear ends;

a supporter (4) fixed to said frame for fixedly supporting said first connectors (40) in a condition where said first connectors are disposed in said rear open end with said first engaging sides being directed to said front open end; and a unitary conductive plate forming a connector carrier (7) slidably mounted in forward and rearward directions within said frame, said connector carrier comprising a connector holding portion (8) disposed in front of said first connectors disposed in said rear open end of said frame for holding said second connectors (30) with said second engaging sides directed to said rear end, and an operating portion (15) of said carrier (7) projecting out of said frame for moving said connector carrier in forward and rearward directions, said second connectors being held on said connector holding portions when said connector carrier is positioned at a first position at the front open end, said second connectors being brought into electrical connection with said first connectors when said connector carrier having said second connectors thereon is pulled to a second position at the rear open end to engage said first engaging sides with said second engaging sides, respectively, and said second connectors being electrically disconnected from said first connector when said connector carrier is pulled from said second position to said first position, said unitary conductive plate forming a connector carrier having a seating plate portion (7*a*), said first connectors being mounted on a printed circuit board, said connector holding portion (8) having a holding parts (8*a*) and a spring parts (8*b*), each of said second connectors (30) being inserted into the connector carrier (7) and held by said connector holding portion.

2. A connector engaging and disengaging device as claimed in claim 1, wherein said first connectors are disposed in a plurality of parallel connector lines, each of said connector lines extending in a lateral direction and having a plural ones of said first connectors, while a plurality of connector carriers are provided to said frame corresponding to said plurality of parallel connector lines.

3. A connector engaging and disengaging device as claimed in claim 2, wherein said first connectors are mounted on a printed circuit board, said printed circuit board being fixed to said frame by said supporter, and wherein said second connectors are connected to electrical cables, respectively.

4. A connector assembly having a connector engaging/disengaging mechanism for engaging and disengaging a plurality of first connectors to and from a plurality of second connectors in one-to-one correspondence, said first connectors being mounted on a printed circuit board, said second connectors being connected to a plurality of cables, respectively, said assembly comprising:

a panel having an opening;

a frame member fixedly mounted on said a panel along a periphery of said opening;

said printed circuit board fixed onto said frame member inside said opening;

said first connectors mounted on said printed circuit board;

said second connectors; and said connector engaging/disengaging mechanism, which comprises:

a plurality of plate-like connector carriers mounted on said frame member and being slidable in a connector engaging/disengaging direction perpendicular to said panel, each of said connector carriers comprises a plurality of seating plate portions for seating plural ones of said second connectors, a plurality of connector holding portions formed on said seating plate portions to hold said second connectors seated thereon, and a pair of operating portions for moving said connector carrier said connector engaging and disengaging direction to engage and disengage said first connectors to and from said second connectors;

a plurality of guide portions for guiding of said connector carrier moving in said engaging and disengaging direction.

5. A connector assembly as claimed in claim 4, further comprising a stiffener to which said board is attached, said stiffener being fixed to said frame member.

6. A connector assembly as claimed in claim 4, wherein said frame member comprises a pair of side wall portions parallel to each other, said guide portions being grooves formed in said fide wall portions.

7. A connector assembly as claimed in claim 4, wherein each of said second connectors has an engaging end for engaging with a corresponding one of said first connectors, a pair of opposite side faces, a pair of connector locking portions formed in said opposite side faces apart from said engaging end, and a pair of shoulder portions formed on said opposite side faces adjacent said engaging end, and wherein said connector carrier has a plurality of connector holding portions to be engaged with said pair of connector engaging portions to lock said second connector in said disengaging direction, and a plurality of connector stopper portions to be abutted to said pair of shoulder portions to locate said second connector in a predetermined position.

8. A connector assembly as claimed in claim 7, wherein said connector holding portions have a plurality of holding parts standing from said seating plate portion, and a plurality of spring parts having elasticity and extending from said holding parts in said insert direction, said connector locking portions being recesses engaged with free ends of said spring parts in said disengaging direction.

9. A connector assembly as claimed in claim 7, wherein said connector holding portions and said connector stopper portions are made of a plate material common to said seating plate portion and formed by bending said plate material upward from said seating plate portion.

10. A connector assembly as claimed in claim 4, wherein said operating portions are made of a plate material common to said seating plate portion and have extending parts extending out of said seating plate portion on a plane common to said seating plate portion.

11. A connector assembly as claimed in claim 10, wherein said operating portions have operating parts formed by bending upward from forward ends of said extending parts.

12. A connector assembly as claimed in claim 10, wherein said extending parts are provided with stopper parts extending outwards in a longitudinal direction of said connector carrier to be abutted to said frame member when said connector carrier is moved in said disengaging direction.

13. A connector assembly as claimed in claim 4, wherein a plurality of said connector carriers are held in parallel by said guide portions formed in said frame member in a multi-stage fashion.

* * * * *

UNITED STATES PATENT AND TRADEMARK OFFICE

CERTIFICATE OF CORRECTION

PATENT NO. : 6,287,135 B1
DATED : September 11, 2001
INVENTOR(S) : Osamu Hashiguchi et al.

It is certified that error appears in the above-identified patent and that said Letters Patent is hereby corrected as shown below:

Column 3,
Line 53, delete “d3b” and insert -- 3b --;

Column 4,
Line 5, delete “3D” and insert -- 3d --;

Column 7,
Line 6, delete “connected each” and insert -- connected to each --;

Column 8,
Line 58, delete “fide” and insert -- side --;

Signed and Sealed this

Fourth Day of June, 2002

*Attest:*

*Attesting Officer*

JAMES E. ROGAN
*Director of the United States Patent and Trademark Office*